United States Patent [19]

Hayama

[11] Patent Number: 4,867,637

[45] Date of Patent: Sep. 19, 1989

[54] VARIABLE AREA NOZZLE TURBINE

[75] Inventor: Masato Hayama, Saitama, Japan

[73] Assignee: Honda Giken Kogyo Kabushiki Kaisha, Tokyo, Japan

[21] Appl. No.: 310,357

[22] Filed: Feb. 13, 1989

[30] Foreign Application Priority Data

Mar. 8, 1988 [JP] Japan ..... 63-054334

[51] Int. Cl.[4] ..... F01D 17/16

[52] U.S. Cl. ..... 415/164; 415/148; 415/151

[58] Field of Search ..... 415/148, 149 R, 150, 415/151, 159, 160, 161, 162, 163, 164, 165

[56] References Cited

U.S. PATENT DOCUMENTS

| | | | |
|---|---|---|---|
| 2,648,195 | 8/1953 | Wilde et al. | 415/164 |
| 2,860,827 | 11/1958 | Egli | 415/164 |
| 3,101,926 | 8/1963 | Weber | 415/164 |
| 4,678,397 | 7/1987 | Komatsu et al. | 415/151 |
| 4,702,672 | 10/1987 | Leicht et al. | 415/164 |
| 4,776,757 | 10/1988 | Sedille et al. | 415/164 |
| 4,780,054 | 10/1988 | Yano et al. | 415/164 |
| 4,799,856 | 1/1989 | Matsudaira et al. | 415/164 |

FOREIGN PATENT DOCUMENTS

| | | | |
|---|---|---|---|
| 129731 | 10/1950 | Switzerland | 415/164 |
| 715812 | 2/1980 | U.S.S.R. | 415/164 |

*Primary Examiner*—Robert E. Garrett
*Assistant Examiner*—John T. Kwon
*Attorney, Agent, or Firm*—Lyon & Lyon

[57] ABSTRACT

A radial turbine of a variable area nozzle type which is suitable for use as the exhaust turbine of a turbocharger for an automotive internal combustion engine requiring a quick response and a wide operating range. This turbine comprises at least two groups of variable area nozzles which may be, for instance, defined by moveable vanes, and can be individually controlled for each group to vary their sizes. By opening the variable area nozzles of the first group while the variable area nozzles of the second group are kept closed, a sufficient supercharging effect can be obtained even when the fluid flow rate is small. By opening the variable area nozzles of both the groups, the resistance to the fluid flow can be reduced and the creation of excessive back pressure at the inlet to the turbine can be avoided even when the fluid flow rate is large. In this way, not only the operating range of the turbine can be expanded but also the control accuracy particularly in small nozzle opening condition can be improved.

7 Claims, 3 Drawing Sheets

VARIABLE AREA NOZZLE TURBINE

TECHNICAL FIELD

The present invention relates to a variable area nozzle turbine, and in particular, but not exclusively, to a radial turbine of a variable area nozzle type which is suitable for use as the exhaust turbine of a turbocharger for an automotive internal combustion engine.

BACKGROUND OF THE INVENTION

A radial turbine, when it is used as the exhaust turbine of a turbocharger as often is the case, can accomplish a high degree of supercharging even when the speed of the exhaust gas entering the turbine is low by reducing the size of the nozzles defined adjacent to the periphery of the turbine wheel to a small value and thereby increasing the speed of the exhaust gas flow directed to the turbine wheel. On the other hand, in high speed range, narrowing the nozzles causes the efficiency of the engine to drop because the resistance to the flow of the exhaust gas increases and a considerable back pressure is created in the exhaust system of the engine.

Such a property of the radial turbine for a turbocharger is characterized by the ratio of the cross-sectional area A of the throat section of the scroll passage to the distance R between the center of the cross-section and the center of the turbine wheel. When this ratio A/R is small, the speed of the exhaust gas directed to the turbine wheel is accelerated and a high degree of supercharging is possible even in low speed range, but a significant back pressure is produced in the exhaust system in high speed range. On the other hand, when this ratio A/R is large, the turbine produces a relatively low back pressure even in high speed range but the speed of the exhaust gas directed to the turbine wheel is relatively so low in low speed range that a sufficient degree of supercharging is possible only in a relatively high speed range.

According to U.S. Pat. No. 3,101 926 issued to Weber and U.S. Pat. No. 2,860,827 issued to Egli, this problem is avoided by rotating, around axial pivot pins, a plurality of moveable vanes arranged around the periphery of the turbine wheel to vary the opening area of the nozzles defined between the adjacent vanes. According to these proposals, a sufficient supercharging effect is obtained even in low speed range of the engine by narrowing the nozzles, and the back pressure working against the exhaust gas of the engine is reduced in medium to high speed range by increasing the size of the nozzles.

However, according to these prior inventions, since the moveable vanes are arranged in such a region where the speed of the fluid is relatively high, the resistance loss of the fluid flow is accordingly high, and, therefore, not only the efficiency of the turbine is reduced but also, because the opening area of the nozzles between adjacent moveable vanes changes considerably even for a small change in the angle of the moveable vanes particularly when the opening area is small, desirable precision in control is not easy to obtain.

Further, it is also known to define a part of the wall of the scroll passage with a flap which is capable of a swinging motion to vary the A/R ratio, for instance, from U.S. Pat. No. 4,678,397 issued to Komatsu, for instance, but its range of nozzle area variation is not necessarily wide enough, and, further, particularly when the flap opening angle is large, the fluid flow directed towards the turbine wheel becomes so disturbed and uneven that the turbine efficiency drops.

To eliminate such problems, an improved variable capacity turbine was proposed in copending U.S. patent application Ser. No. 054,499, filed May 27, 1987, which comprises a plurality of arcuate fixed vanes arranged around a throat section defined around the periphery of a turbine wheel, and moveable vanes which vary the nozzle area defined between the moveable vanes and the fixed vanes. However, according to this proposal, a certain difficulty was encountered in further expanding the range of the A/R ratio control because the moveable vanes were moved at a fixed control precision irrespective of the angle of the moveable vanes, and a fine control of the nozzle opening area was not possible for a given range of exhaust gas flow rate. If the control system is tuned for a fine adjustment of the nozzle opening area in low nozzle opening range, the turbine will be incapable of handling a large flow rate of the exhaust gas without causing a significant increase in the back pressure in the exhaust system.

BRIEF SUMMARY OF THE INVENTION

A primary object of the present invention is to provide a variable area nozzle turbine with an increased range of fluid speed control which is capable of high precision control even when the flow rate of the fluid is small, and involves a relatively small resistance loss when the flow rate is large.

A second object of the present invention is to provide such a variable area nozzle turbine which is economical to manufacture and reliable to use.

These and other objects of the present invention can be accomplished by providing a variable area nozzle turbine, comprising: a casing defining a scroll passage and an axial passage communicated with a central part of the scroll passage; a turbine wheel rotatably arranged in the central part of the scroll passage; and a plurality of angularly spaced variable area nozzles arranged around the outer periphery of the turbine wheel; wherein: the variable area nozzles comprise at least two groups of variable area nozzles which groups can be individually controlled to vary their sizes.

In this way, a sufficient supercharging effect can be obtained with a high level of control accuracy even when the flow rate is small by adjustably opening only the nozzles of the first group while the nozzles of the second group are kept closed, and the resistance loss of the fluid can be reduced when the flow rate is increased by additionally and adjustably opening the variable area nozzles of the second group while the variable area nozzles of the first group are kept fully open.

According to a particularly preferred embodiment of the present invention, the variable area nozzles of the different groups are arranged in an alternating fashion around the turbine wheel, and, preferably, each of the variable area nozzles is defined by a moveable vane which is pivoted at its leading edge by an axial pin so as to define the variable size of the nozzle with its trailing edge and the leading edge of an adjacent vane which may be either moveable or fixed.

The present invention can offer a particularly significant advantage when it is used as the exhaust turbine of a turbocharger for an automotive internal combustion engine which requires a precise nozzle control over a wide range of exhaust gas flow rate and a quick response.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
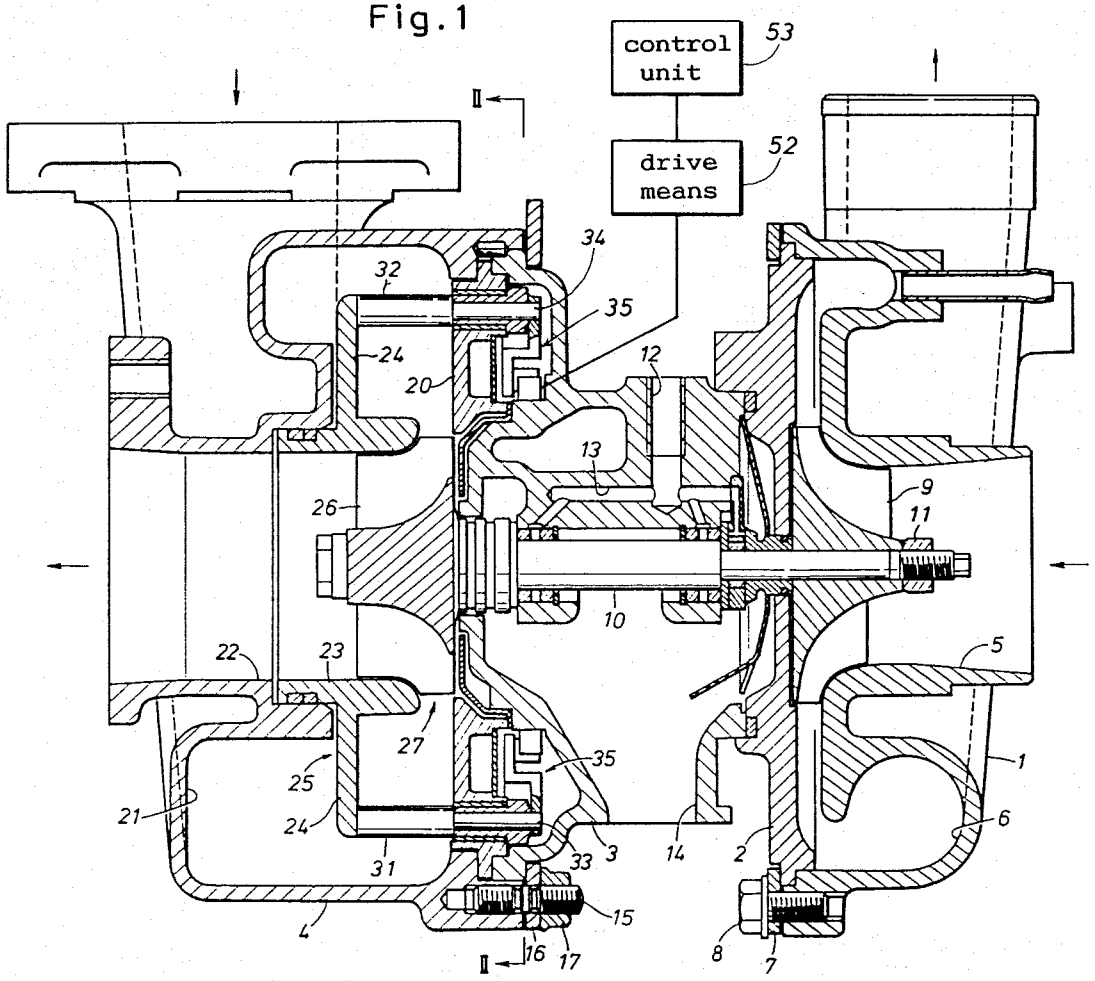
FIG. 1 is a sectional view of a turbocharger to which the present invention is applied.

FIG. 1 shows a turbocharger for an internal combustion engine to which the variable nozzle area turbine of the present invention is applied. This turbocharger is provided with a compressor casing 1 accommodating a compressor unit for compressing the intake of an engine not shown in the drawings, a back plate 2 which closes the rear of the compressor casing 1, a lubrication unit casing 3 for rotatably supporting the main shaft 10 of the turbocharger and lubricating the bearings for the main shaft 10, and a turbine casing 4 accommodating a turbine unit which is driven by exhaust gas from the engine to supply rotary power to the compressor unit via the main shaft.

The compressor casing 1 internally defines an intake inlet passage 5 which opens out in the axial direction, and a scroll passage 6 serving as the outlet for the intake, and is integrally joined to the back plate 2 by means of threaded bolts 8 with a ring member 7 interposed therebetween. In the center of the scroll passage 6 is arranged a compressor wheel 9 so as to adjoin the internal end of the intake inlet passage 5. The compressor wheel 9 is integrally attached to an end of the main shaft 10 by means of a nut 11, the main shaft 10 being rotatably supported in the center of the lubrication unit casing 3.

The lubrication unit casing 3 is connected to the center of the back plate 2. The upper part of the lubrication unit casing 3 is provided with a lubrication oil introduction hole 12, from which the lubrication oil, supplied by a lubrication oil pump not shown in the drawings, is fed to various parts of the bearings for the main shaft 10 via a lubrication oil passage 13, and is expelled from an outlet 14 provided in a lower part of the lubrication unit casing 3. To avoid the lubrication oil from entering the compressor unit, known sealing means such as a shield plate and so on is interposed between the back plate 2 and the lubrication unit casing 3.

The turbine casing 4 is integrally attached to the other end of the lubrication unit casing 3, along with a back plate 20, by threading nuts 17 to stud bolts 15 which are in turn threaded into the rear end of the turbine casing 4, with a ring member 16 interposed between a mounting flange of the lubrication unit casing 3 and the nuts 17. The interior of the turbine casing 4 defines a scroll passage 21 whose cross-sectional area progressively diminishes towards the downstream end thereof, and an exhaust outlet passage 22 which extends axially from the center of the scroll passage 21.

Centrally of the scroll passage 21 is arranged a vane support member 25 comprising a tubular portion 23 smoothly connected to the exhaust outlet passage 22 and a disk portion 24 extending radially from the tubular portion 23. The tubular portion 23 accommodates therein a turbine wheel 26 which is, for instance, made of ceramics, and is integrally attached to the other end of the main shaft 10. This vane support member 25 defines in cooperation with the back plate 20 a throat section 27 having a locally minimum cross-section which adjoins the inlet of the turbine wheel 26.

Figure 2:
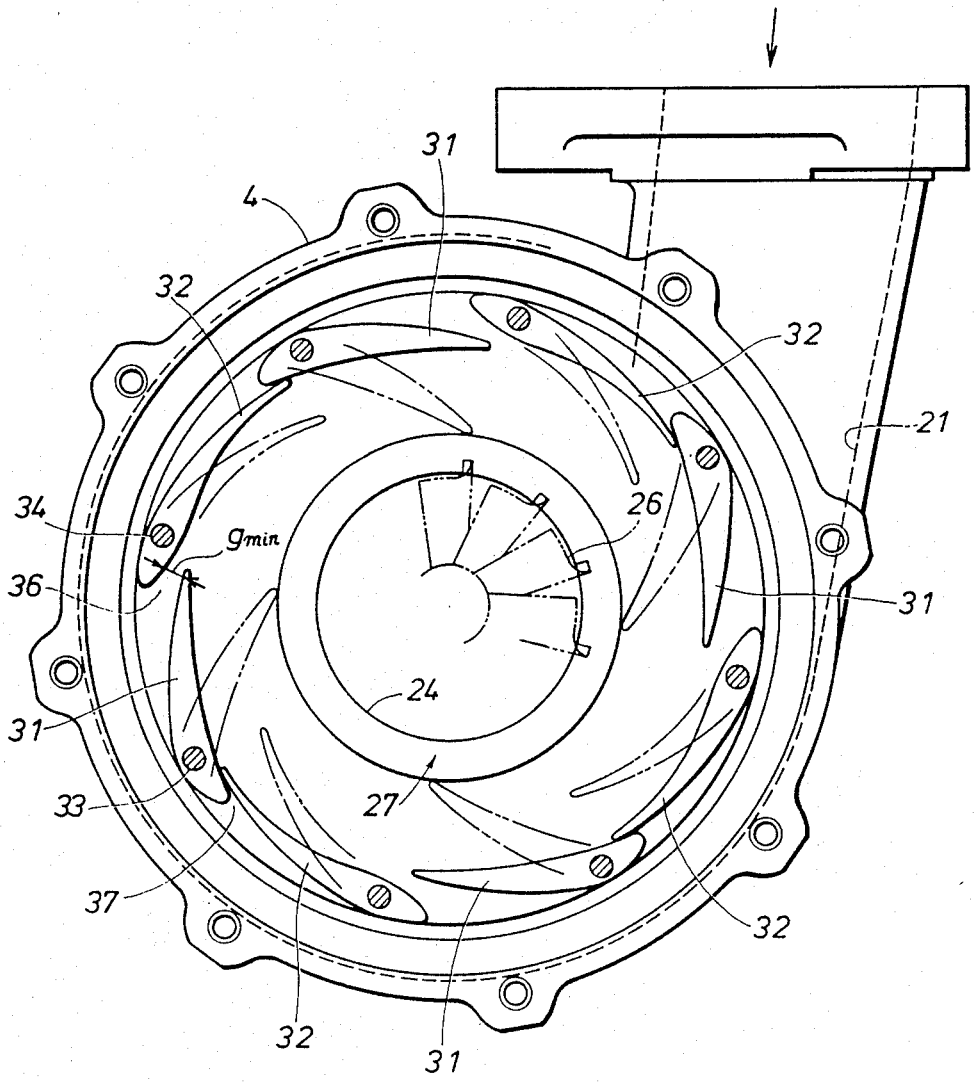
FIG. 2 is a sectional view taken along line II—II of FIG. 1.

As best shown in FIG. 2, the vane support member 25 accommodates four first moveable vanes 31 and four second moveable vanes 32 in the annular space defined between the disk portion 24 and the back plate 20. The first and second moveable vanes 31 and 32 are each arcuate in shape, and are arranged along a circle concentric to the turbine wheel 26 in an alternating manner and at equal interval. The first moveable vanes 31 are pivoted by pins 33 at their leading edges so as to swing from the concentric circle only inwardly of the concentric circle within the annular space defined between the disk portion 23 and the back plate 20. Likewise, the second vanes 32 are pivoted by pins 34 at their leading edges so as to swing from the concentric circle inwardly of the concentric circle within the annular space defined between the disk portion 23 and the back plate 20. The pins 33 and 34 are passed completely through the back plate 20 towards the rear, and the rear most ends of the pins 34 are engaged to an appropriate linkage mechanism 35. The moveable vanes 31 and 32 are activated by external drive means 52 which are coupled to them via the linkage mechanism 35. The drive means is in turn controlled by a control unit 53.

First nozzles 36 are defined in the regions where the trailing edges of the first moveable vanes 31 and the leading edges of the second moveable vanes 32 overlap each other along the circumferential direction, and second nozzles 37 are defined where the leading edges of the first vanes 31 and the trailing edges of the second vanes 32 overlap each other along the circumferential direction. When the first moveable vanes 31 and the second moveable vanes 32 are both in their most closed positions as shown by the solid lines in FIG. 2, a minimum gap gmin is defined in each of the first nozzles 36 with the trailing edges of the first moveable vanes 31 and the leading edges of the second moveable vanes 32 slightly spaced from each other along the radial direction. On the other hand, the second nozzles 37 are substantially closed with the leading edges of the first moveable vanes 31 substantially touching the trailing edges of the second moveable vanes 32. By controlling the opening area of the first nozzles 36 with the drive means 52 under the control of the control unit 53 at high precision, the incoming flow of the exhaust gas is narrowed and accelerated according to its flow rate, and is turned into a spiral flow in the throat section 27 before it impinges upon the turbine wheel 26 whereby the optimum supercharging effect can be ensured even in low speed range of the engine. The swinging motion of the first moveable vanes 31 creates small gaps in the second nozzles 37 also, but would not substantially affect the control of the opening degree of the first nozzles 35 or the supercharging effect.

When the rotational speed of the engine has increased to a predetermined value Ne, the first nozzles 36 become fully open with the first moveable vanes 31 assuming the positions indicated by the imaginary lines in FIG. 2. The predetermined value Ne is the intercept value at which the supercharging effect of the turbocharger stops increasing even when the flow rate of exhaust gas keeps increasing. When the rotational speed of the engine increases further and the flow rate of exhaust gas accordingly increases, the second moveable vanes 32 start moving while the first moveable vanes 31 are fixed at their most open state where the trailing edges of the first moveable vanes 31 extend to the immediate vicinity of the outer periphery of the turbine wheel 26 as indicated by imaginary lines in FIG. 2. The second moveable vanes 32 move between their fully closed positions and fully open positions where the trailing edges of the second moveable vanes 32 extend to the immediate vicinity of the outer periphery of the turbine wheel 26 as indicated by imaginary lines in FIG. 2. By thus increasing the opening degree of the second nozzles 36 while the opening degree of the first nozzles 35 is fixed at their fully open state, the speed of the exhaust gas flow is avoided from being excessively increased for a given increase of the flow rate of the exhaust gas, and the flow resistance is thereby avoided from being excessively increased. As a result, the back pressure in the exhaust system is reduced, and the loss of the turbine efficiency can be avoided.

Figure 3:
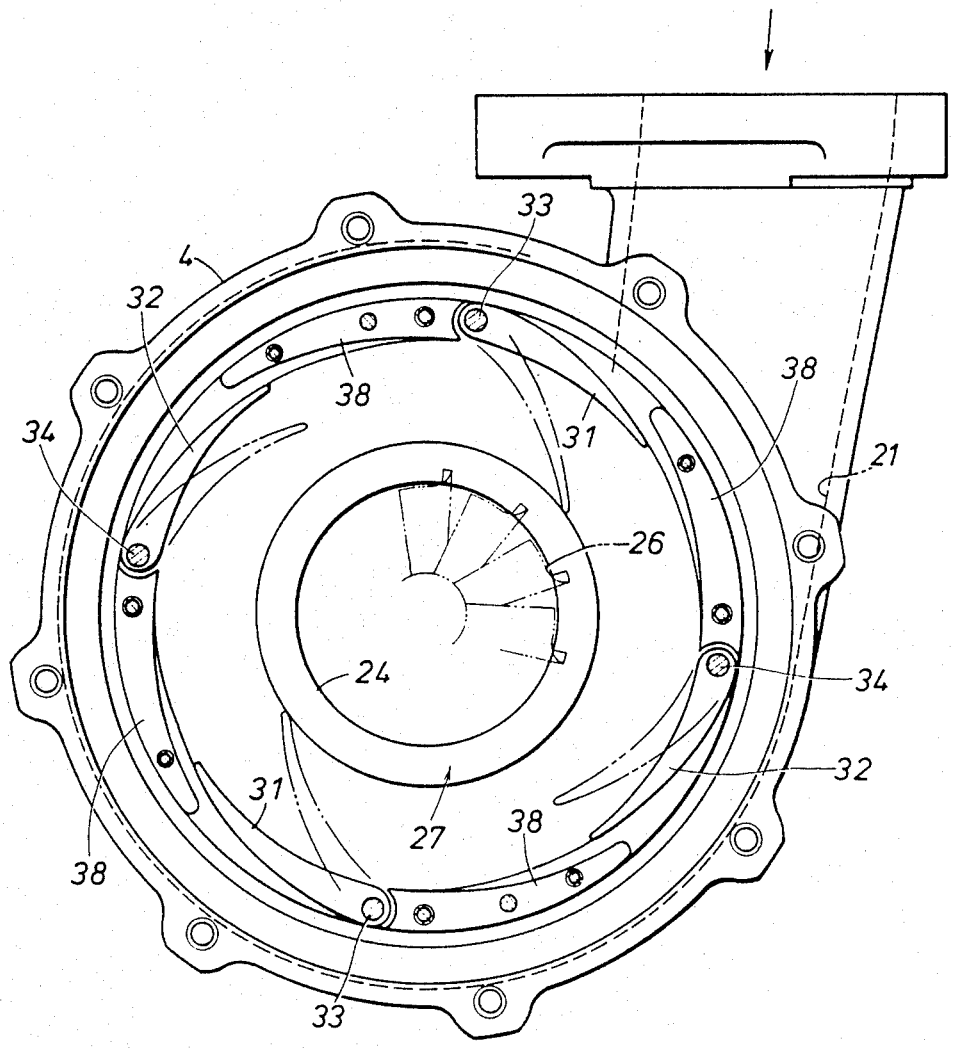
FIG. 3 is a sectional view similar to FIG. 2 showing a second embodiment of the present invention.

FIG. 3 shows a second embodiment of the present invention in which four fixed arcuate vanes 38 are arranged around the turbine wheel 24 at equal interval defining four circumferential gaps therebetween. A pair of first moveable vanes 31 are arranged in the two gaps which diametrically oppose each other with the leading edges thereof pivotally supported by axial pins 33 in such a manner that the trailing edges of these first moveable vanes 31 may be moved between the most closed positions where they circumferentially align with the fixed arcuate vanes 38 on a common circle concentric to the turbine wheel 24 and the most open positions where the trailing edges of the first moveable vanes 31 come to the immediate vicinity of the periphery of the turbine wheel 24. Another pair of second moveable vanes 32 are arranged in the other two gaps which likewise diametrically oppose each other with the leading edges thereof pivotally supported by axial pins 34 in such a manner that the trailing edges of these second moveable vanes 32 may be moved between the most closed positions where they circumferentially align with the fixed arcuate vanes 38 on a common circle concentric to the turbine wheel 24 and the most open positions where the trailing edges of the second moveable vanes 32 come to the immediate vicinity of the periphery of the turbine wheel 24.

In this embodiment also, to achieve both a fine control in the substantially closed nozzle condition and reduced flow resistance in the substantially open nozzle condition, the second moveable vanes 32 are kept at their most closed positions until the first moveable vanes 31 reach their most open positions. Thereafter, the first moveable vanes 31 are kept at their most open positions while the second moveable vanes 32 move between their most closed positions and most open positions as required.

The present invention is in no way limited by the aforementioned embodiments, but various modifications and different control methods can be conceived. For instance, the numbers of the first and second moveable vanes, and their shapes, dimensions and arrangements can be modified in various ways according to the desired property of the turbine. Further, by adding third moveable vanes, even more precise control may be possible. The first and second moveable vanes may be controlled with separate drive means either simultaneously or individually.

As described above, according to the present invention, the two groups of moveable vanes were used one after the other to expand the dynamic range of control accuracy. In this case, the control precision may be linear throughout the operating range of the control system. However, optionally, the first moveable vanes and the second moveable vanes may have different levels of control precision so that the first moveable vanes having a relatively higher level of control precision are used when the flow rate of the fluid is small and both the first and the second moveable vanes are used for reducing the flow resistance and avoiding the reduction of the turbine efficiency when the flow rate of the fluid is large. Therefore, the control precision of the second moveable vanes may be reduced, for instance by allow the second moveable vanes to move only in discrete steps while the first moveable vanes are allowed to move in finer steps or even continuously, without substantially affecting the control precision of the system.

In either case, particularly when the turbine is used as the exhaust turbine of a turbocharger for an automotive internal combustion engine, it can offer a sufficient and optimum supercharging effect in low speed range of the engine and the expansion of the flow rate control range in medium to high speed range of the engine at the same time.

What we claim is:

1. A variable area nozzle turbine, comprising:

a casing defining a scroll passage and an axial passage communicated with a central part of said scroll passage;

a turbine wheel rotatably arranged in said central part of said scroll passage; and a plurality of angularly spaced variable area nozzles arranged around the outer periphery of said turbine wheel;

wherein:

said variable area nozzles comprise at least two groups of variable area nozzles which groups can be individually controlled to vary their sizes.

2. A variable area nozzle turbine as defined in claim 1, further comprising control means for opening said variable area nozzles of said first group to a desired extent, and keeping said variable nozzles of said second group closed when the flow rate of working fluid is less than a prescribed value; and for keeping said variable area nozzles of said first group fully open, and opening said variable area nozzles of said second group to a desired extent when the flow rate of said working fluid is greater than said prescribed value.

3. A variable area nozzle turbine as defined in claim 2, wherein said variable area nozzles of said different groups are arranged in an alternating fashion around said turbine wheel.

4. A variable area nozzle turbine as defined in claim 2, wherein each of said variable area nozzles is defined by a moveable vane which is p ivoted at its leading edge by an axiasl pin and defines a variable size of the nozzle with its trailing edge and the leading edge of an adjacent vane.

5. A variable area nozzle turbine as defined in claim 4, wherein said adjacent vane is another moveable vane.

6. A variable area nozzle turbine as defined in claim 4, wherein said adjacent vane is a fixed vane.

7. A variable area nozzle turbine as defined in any of the preceding claims, which is used as the exhaust turbine of a turbocharger for an automotive internal combustion engine.

* * * * *